US008632075B2

(12) United States Patent
Sha

(10) Patent No.: US 8,632,075 B2
(45) Date of Patent: Jan. 21, 2014

(54) SEAL ASSEMBLY AND METHOD FOR FLOWING HOT GAS IN A TURBINE

(75) Inventor: Karimulla Shaik Sha, Andhra Pradesh (IN)

(73) Assignee: General Electric Company, Schenectady, NY (US)

( * ) Notice: Subject to any disclaimer, the term of this patent is extended or adjusted under 35 U.S.C. 154(b) by 17 days.

(21) Appl. No.: 13/205,153

(22) Filed: Aug. 8, 2011

(65) Prior Publication Data

US 2013/0038022 A1 Feb. 14, 2013

(51) Int. Cl.
*F01D 11/02* (2006.01)

(52) U.S. Cl.
USPC ..... 277/355

(58) Field of Classification Search
None
See application file for complete search history.

(56) References Cited

U.S. PATENT DOCUMENTS

| | | | | | |
|---|---|---|---|---|---|
| 5,074,748 | A * | 12/1991 | Hagle | 415/170.1 |
| 5,114,159 | A | 5/1992 | Baird et al. | |
| 5,265,412 | A * | 11/1993 | Bagepalli et al. | 60/800 |
| 5,400,586 | A * | 3/1995 | Bagepalli et al. | 60/800 |
| 5,975,535 | A * | 11/1999 | Gail et al. | 277/355 |
| 6,032,959 | A * | 3/2000 | Carter | 277/355 |
| 6,079,945 | A | 6/2000 | Wolfe et al. | |
| 6,105,966 | A | 8/2000 | Turnquist et al. | |
| 6,170,831 | B1 * | 1/2001 | Bouchard | 277/355 |
| 6,352,263 | B1 * | 3/2002 | Gail et al. | 277/355 |
| 6,402,157 | B1 * | 6/2002 | Zhou et al. | 277/355 |
| 2004/0041348 | A1 * | 3/2004 | Addis | 277/355 |
| 2007/0018409 | A1 * | 1/2007 | Justak | 277/355 |
| 2011/0200432 | A1 * | 8/2011 | Alamsetty et al. | 415/230 |

* cited by examiner

*Primary Examiner* — Vishal Patel
*Assistant Examiner* — Thomas Neubauer
(74) *Attorney, Agent, or Firm* — Cantor Colburn LLP

(57) ABSTRACT

According to one aspect of the invention, a seal assembly includes a mounting structure coupled to an inner static structure in a turbine. Further, the seal assembly includes a brush seal member coupled to the mounting structure, wherein the brush seal member includes a first end that is in sealing contact with a rotor and a second end in sealing contact with a stator and wherein the brush seal member includes a plurality of bristles.

16 Claims, 2 Drawing Sheets

SEAL ASSEMBLY AND METHOD FOR FLOWING HOT GAS IN A TURBINE

BACKGROUND OF THE INVENTION

The subject matter disclosed herein relates to gas turbines. More particularly, the subject matter relates to seals between components of gas turbines.

In a gas turbine, a combustor converts chemical energy of a fuel or an air-fuel mixture into thermal energy. The thermal energy is conveyed by a fluid, often compressed air from a compressor, to a turbine where the thermal energy is converted to mechanical energy. Leakage of the compressed air between compressor parts or components causes reduced power output and lower efficiency for the turbine. Leaks may be caused by thermal expansion of certain components and relative movement between components during operation of the gas turbine. Accordingly, reducing gas leaks between components can improve efficiency and performance of the turbine.

BRIEF DESCRIPTION OF THE INVENTION

According to one aspect of the invention, a seal assembly includes a mounting structure coupled to an inner static structure in a turbine. Further, the seal assembly includes a brush seal member coupled to the mounting structure, wherein the brush seal member includes a first end that is in sealing contact with a rotor and a second end in sealing contact with a stator and wherein the brush seal member includes a plurality of bristles.

According to another aspect of the invention, a seal assembly for a turbine includes a flexible seal member including a first end and a second end, wherein the first and second ends each extend from a static structure located between a rotor and a stator vane, wherein the first end provides sealing contact between the static structure and the rotor and the second end provides sealing contact between the static structure and the stator vane.

According to yet another aspect of the invention, a seal assembly for a turbine includes a stator vane is positioned radially outside an inner barrel of a compressor and a brush seal member that includes a plurality of bristles extending from the inner barrel, wherein a first end of the brush seal member extends from the inner barrel to provide sealing contact with the stator vane to reduce a back flow of hot gas between the stator vane and the inner barrel. The assembly further includes a second end of the brush seal member providing sealing contact with a rotor to reduce leakage of the hot gas between the inner barrel and the rotor.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
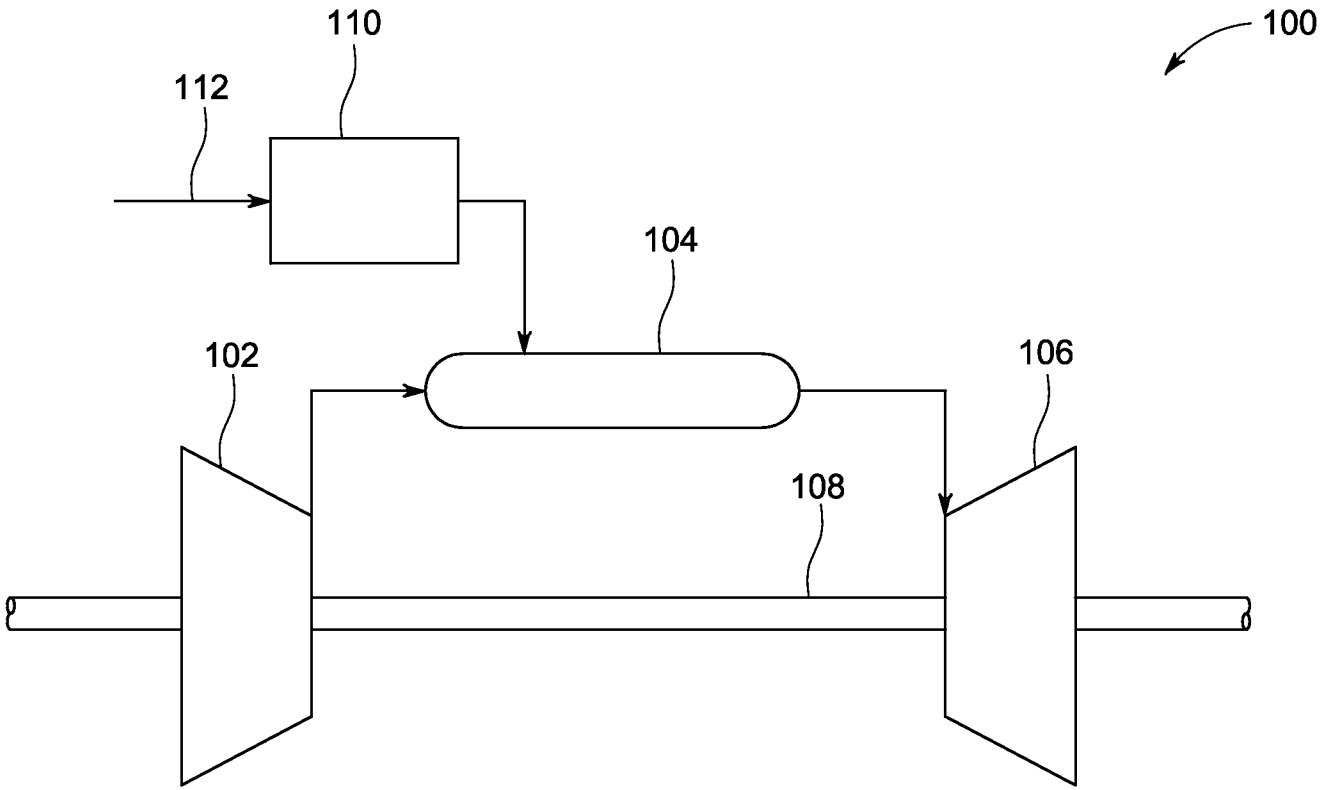
FIG. 1 is a schematic drawing of an embodiment of a gas turbine engine, including a combustor, fuel nozzle, compressor and turbine.

FIG. 1 is a schematic diagram of an embodiment of a gas turbine system 100. The system 100 includes a compressor 102, a combustor 104, a turbine 106, a shaft 108 and a fuel nozzle 110. In an embodiment, the system 100 may include a plurality of compressors 102, combustors 104, turbines 106, shafts 108 and fuel nozzles 110. The compressor 102 and turbine 106 are coupled by the shaft 108. The shaft 108 may be a single shaft or a plurality of shaft segments coupled together to form shaft 108.

In an aspect, the combustor 104 uses liquid and/or gas fuel, such as natural gas or a hydrogen rich synthetic gas, to run the engine. For example, fuel nozzles 110 are in fluid communication with an air supply and a fuel supply 112. The fuel nozzles 110 create an air-fuel mixture, and discharge the air-fuel mixture into the combustor 104, thereby causing a combustion that heats a pressurized gas. The combustor 100 directs the hot pressurized exhaust gas through a transition piece into a turbine nozzle (or "stage one nozzle") and then a turbine bucket, causing turbine 106 rotation. The rotation of turbine 106 causes the shaft 108 to rotate, thereby compressing the air as it flows into the compressor 102. The turbine components or parts are joined by seals or seal assemblies configured to allow for thermal expansion and relative movement of the parts while preventing leakage of the gas as it flows through the turbine 106. Specifically, reducing leakage of compressed gas flow between components in the compressor increases the volume hot gas flow along the desired path, enabling work to be extracted from more of the hot gas, leading to improved turbine efficiency. Seals and seal assemblies for placement between compressor parts are discussed in detail below with reference to FIGS. 2 and 3.

Figure 2:
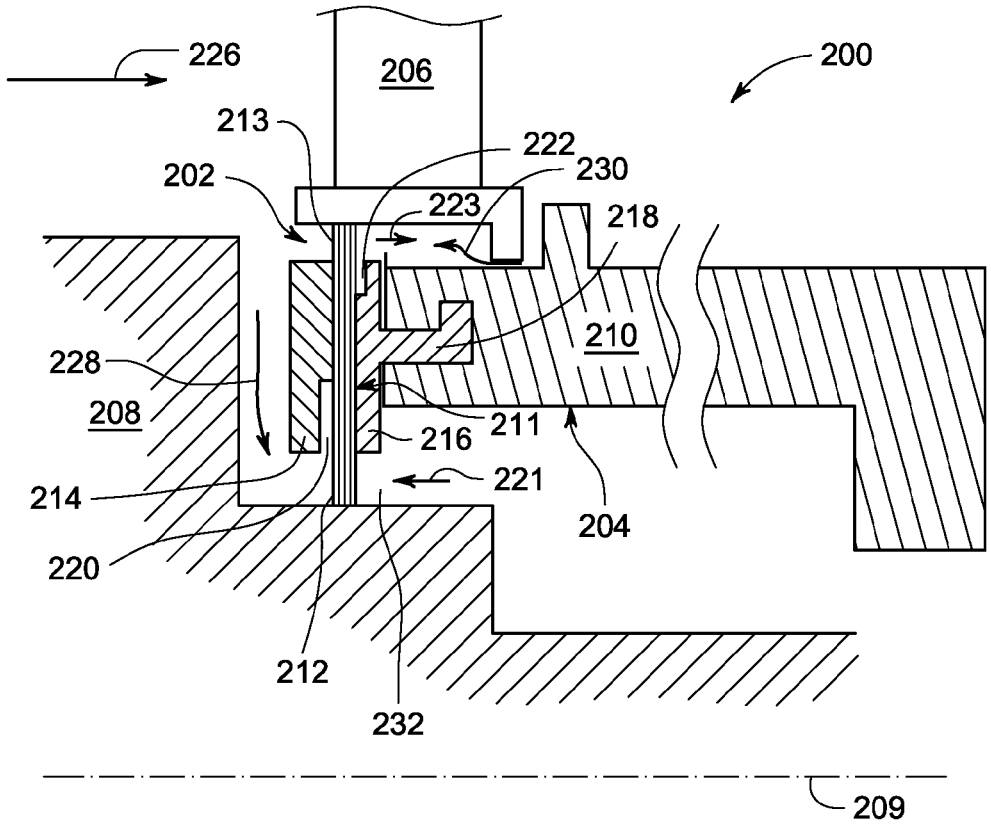
FIG. 2 is side view of a portion of an exemplary compressor.

Referring now to FIG. 2, a side view of a portion of an exemplary compressor 200 is shown. The compressor 200 includes a seal assembly 202 coupled to a barrel assembly 204 (also referred to as "inner static structure" or "inner casing assembly"). The seal assembly 202 is in sealing contact with a stator exit vane 206 and a rotor 208. The barrel assembly 204 and the stator exit vane 206 are substantially stationary while the rotor rotates about an axis 209. In aspects, the stator vane 206 is coupled to an outer casing positioned radially outside the barrel assembly 204 of the compressor 102 (FIG. 1). In an embodiment, the stator exit vane 206 (or stator vane) is included in the stator portion of the compressor 102 exit stage. In addition, the barrel assembly 204 includes an inner barrel 210. The seal assembly 202 includes a brush seal member 211 with a first end 212 and a second end 213. The brush seal member 211 is positioned on a suitable mounting structure to provide sealing contact with adjacent compressor 102 components. For example, the exemplary brush seal member 211 is positioned between a first plate 214 and a second plate 216, wherein the first and second plates 214, 216 are part of and/or coupled to the barrel assembly 204. In the embodiment, the brush seal member 211 is coupled to the first and second plates 214, 216 substantially near a center of the brush seal member 211, thereby exposing each end (212, 213) of the brush seal member 211. Further, the first end 212 extends substantially radially inward from the mounting structure and the second end 213 extends substantially radially outward from the mounting structure. In one embodiment, the second plate 216 includes a coupling, such as a hook coupling 218, to couple to the inner barrel 210.

As depicted, the first plate 214 includes a first recess 220 to enable movement of the brush seal member 211 (also referred to as flexible seal member) in a first direction 221. Similarly, the second plate 216 includes a second recess 222 to enable movement of the brush seal member 211 in a second direction 223. During operation of the exemplary turbine system 100, a hot gas flow 226 is directed across the stator exit vane 206. Compressor 102 efficiency is reduced when the hot gas flow 226 loses velocity and/or fluid due to leakage or back flow. A first flow path 228 shows a gas flow path that may leak between the rotor 208 and the inner barrel 210. Accordingly, the velocity of the hot gas flow 226 is maintained by positioning the brush seal member 211 to reduce leaking or restrict flow along the first flow path 228. A second flow path 230 shows a path of back flow that may leak between the stator exit vane 206 and the inner barrel 210. Back flow along the second flow path 230 is reduced or restricted by the brush seal member 211. Thus, the brush seal member 211 improves compressor 102 efficiency by restricting leaking and back flow while maintaining velocity of the hot gas flow 226.

Still referring to FIG. 2, the exemplary brush seal member 211 comprises a plurality of bristles, wherein each bristle extends from the first end 212 to the second end 213 of the brush seal member 211. Accordingly, the first end 212 of the brush seal member 211 and corresponding first bristle ends are in sealing contact with the rotor 208. Further, the second end 213 of the brush seal member 211 and corresponding second bristle ends are in sealing contact with the rotor 208. The bristles may be made of any suitable durable material to withstand elevated temperatures in the turbine 100, such as metallic or composite material. In the depicted embodiment, the seal assembly 202 is configured to reduce leaking of the hot gas flow 226 and reduce leaking from a high pressure packing region 232. The high pressure packing region 232 is a high pressure region inside the inner barrel 210 and seal assembly 202 relative to a region outside the inner barrel 210 and seal assembly 202. The brush seal member 211 thereby maintains a desired pressure differential across the seal assembly 202. The exemplary brush seal member 211 comprises bristles with ends 212, 213 configured to provide sealing contact adjacent compressor 102 components, wherein the sealing contact substantially reduces or restricts fluid flow across the seal.

Figure 3:
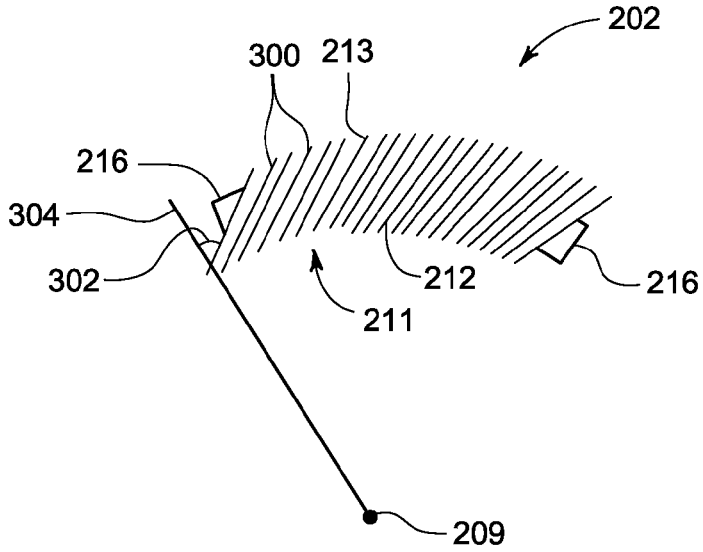
FIG. 3 is a detailed end view of a portion of an exemplary seal assembly.

FIG. 3 is a detailed end view of a portion of the exemplary seal assembly 202, wherein the view is looking downstream within the compressor 102. To show certain parts of the seal assembly 202, the first plate 214 has been removed. In embodiments, a plurality of seal assemblies 202 are positioned circumferentially about the compressor axis 209. In an embodiment, a suitable number of identical seal assemblies, such as 2, 4, 6 or 8 assemblies, comprise a 360 degree assembly disposed in the compressor 202 to reduce leakage of the hot gas flow 226 about the entire compressor 202. For simplicity, a single seal assembly 202 is depicted. The seal assembly 202 includes a plurality of bristles 300, wherein the bristles 300 are canted at an angle 302 with respect to a radial line 304 extending from the axis 209. The canting of bristles 300 provides substantially continuous sealing contact with the rotor 208 and stator exit vane 206 as the rotor 208 rotates about the axis 209. The plurality of bristles 300 includes single bristle pieces configured to maintain sealing contact between the rotor 208 and inner barrel 210, as well as inner barrel 210 and stator exit vane 206. Therefore, the seal assembly 202 including bristles 300 configured to sealingly contact at each end simplifies seal design and production while improving compressor efficiency.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A seal assembly comprising:

an inner static barrel;

a mounting structure, comprising a first plate having an inner end and an outer end, the inner end radially inwardly oriented toward an engine axis of rotation, the outer end oriented radially outwardly toward a stator, the first plate having a first face and a second face, the first face extending radially outwardly from an inner diameter of the mounting structure and the second face extending radially inwardly from an outer diameter of the mounting structure, the mounting structure further comprising a second plate having a third face and a fourth face, the fourth face coupled to the inner static barrel in a turbine; and a brush seal member disposed between the first plate and the second plate, the brush seal member in contact with the second face of the first plate and with the third face of the second plate, wherein the brush seal member comprises a first end that is in sealing contact with a rotor and a second end in sealing contact with the stator and wherein the brush seal member comprises a plurality of bristles, wherein the first plate includes a first recess in the second face located radially inward of the outer end and proximate the inner end to allow movement of the first end of the brush seal member in a first direction and the second plate includes a second recess in the third face, the second recess located radially outward of the inner end and proximate the outer end to allow movement of the second end of the brush seal member in a second direction, wherein the first direction is opposite of the second direction.

2. The seal assembly of claim 1, wherein the mounting structure comprises a first plate and a second plate coupled to the inner static barrel.

3. The seal assembly of claim 2, wherein the second plate is coupled to the inner static barrel by a hook portion of the second plate.

4. The seal assembly of claim 2, wherein the brush seal member is coupled to the first and second plates substantially near a center of the brush seal member.

5. The seal assembly of claim 1, wherein the inner static barrel is positioned radially inside the stator and coupled to an outer static structure.

6. The seal assembly of claim 1, wherein the brush seal member comprises bristles that are canted at an angle with respect to a radial line through an axis of the turbine.

7. The seal assembly of claim 1, wherein the first end extends substantially radially inward from the mounting structure and the second end extends substantially radially outward from the mounting structure.

8. The seal assembly of claim 1, wherein the brush seal member comprises a plurality of bristles positioned between the first plate and the second plate.

9. A seal assembly for a turbine, the seal assembly comprising:

an inner static barrel;

a mounting structure coupled to the inner static barrel located between a rotor and a stator vane, the mounting structure comprising a first plate having an inner end and an outer end, the inner end radially inwardly oriented toward an engine axis of rotation, the outer end oriented radially outwardly toward a stator, the first plate having a first face and a second face, the first face extending radially outwardly from an inner diameter of the mounting structure and the second face extending radially inwardly from an outer diameter of the mounting structure, the mounting structure further comprising a second plate having a third face and a fourth face, the fourth face coupled to the inner static barrel; and a flexible seal member in contact with the second face of the first plate and with the third face of the second plate, the flexible seal member including a first end and a second end, wherein the first end extends radially inward and the second end extends radially outward from the mounting structure, the flexible seal member disposed between the first plate and the second plate wherein the first plate includes a first recess in the second face located radially outward inward proximate the inner end, and the second plate includes a second recess located radially inward proximate the outer end, wherein the first end provides sealing contact between the inner static structure barrel and the rotor and the second end provides sealing contact between the inner static barrel and the stator vane.

10. The seal assembly of claim 9, wherein the flexible seal member comprises a brush seal member.

11. The seal assembly of claim 10, wherein the brush seal member comprises a plurality of bristles, wherein each bristle comprises a first bristle end that forms the first end of the flexible sealing member and a second bristle end that forms the second end of the flexible sealing member.

12. The seal assembly of claim 9, wherein the second plate is coupled to the inner static structure by a hook portion of the second plate.

13. The seal assembly of claim 9, wherein the stator vane is coupled to an outer static structure positioned radially outside the inner static barrel.

14. The seal assembly of claim 9, wherein the first recess is configured to allow movement of the first end of the brush seal member in a first direction and the second plate includes a second recess to allow movement of the second end of the brush seal member in a second direction, wherein the first direction is substantially the opposite of the second direction.

15. A seal assembly for a turbine comprising:

a stator vane is positioned radially outside an inner barrel of a compressor;

a first plate having an inner end and an outer end, the inner end radially inwardly oriented toward an engine axis of rotation, the outer end oriented radially outwardly toward a stator, the first plate having a first face and a second face, the first face extending radially outwardly from an inner diameter of the mounting structure and the second face extending radially inwardly from an outer diameter of the mounting structure;

a second plate having a third face and a fourth face, the fourth face coupled to the inner barrel;

a brush seal member comprising a plurality of bristles extending from the inner barrel and disposed between the first plate and the second plate, the brush seal member in contact with the second face of the first plate and with the third face of the second plate, wherein a first end of the brush seal member extends radially outward from the inner barrel to provide sealing contact with the stator vane to reduce a back flow of hot gas between the stator vane and the inner barrel; and a second end of the brush seal member extending radially inward providing sealing contact with a rotor to reduce leakage of the hot gas between the inner barrel and the rotor, wherein the first plate includes a first recess in the second face located radially outward inward proximate the inner end to allow movement of the first end of the brush seal member in a first direction and the second plate includes a second recess in the first face, the second recess located radially inward proximate the outer end to allow movement of the second end of the brush seal member in a second direction, wherein the first direction is opposite of the second direction.

16. The assembly of claim 15, wherein the brush seal member is coupled to the first plate and the second plate near a center of the brush seal member.

* * * * *